United States Patent [19]

Yoshinari et al.

[11] Patent Number: 4,898,700

[45] Date of Patent: Feb. 6, 1990

[54] PROCESS FOR PRODUCING PREOXIDIZED FIBERS FROM ACRYLIC FIBERS

[75] Inventors: Osamu Yoshinari; Yoshifumi Kawakatsu; Hayashi Takahashi; Hideaki Fukuizumi, all of Shizuoka, Japan

[73] Assignee: Toho Rayon Co., Ltd., Tokyo, Japan

[21] Appl. No.: 252,074

[22] Filed: Sep. 30, 1988

Related U.S. Application Data

[60] Continuation-in-part of Ser. No. 883,399, Jul. 8, 1986, abandoned, which is a division of Ser. No. 610,080, May 14, 1984, Pat. No. 4,659,623.

[30] Foreign Application Priority Data

May 14, 1983 [JP] Japan ..... 58-83483

[51] Int. Cl.[4] ..... D01F 9/22; D01F 11/08

[52] U.S. Cl. ..... 264/83; 264/130; 264/29.2; 264/182; 264/206; 264/211; 264/211.15; 264/211.16; 427/227

[58] Field of Search ..... 264/211.12, 211, 129, 264/130, 83, 29.2, 182, 206, 211.15, 211.16; 427/322, 384, 112, 113, 227, 228, 394, 372.2; 106/287.27; 252/352, DIG. 1, 8.6; 8/115.6

[56] References Cited

U.S. PATENT DOCUMENTS

| | | | |
|---|---|---|---|
| 3,736,164 | 5/1973 | Uffner | 106/287.27 |
| 3,810,772 | 5/1974 | Uffner | 106/287.27 |
| 3,975,482 | 8/1976 | Rulison | 427/227 |
| 3,980,715 | 9/1976 | Szur | 8/115.6 |
| 3,997,604 | 12/1976 | Foulletier et al. | 8/115.6 |
| 4,193,880 | 3/1980 | Marshall | 8/115.6 |
| 4,536,448 | 8/1985 | Ogawa et al. | 427/227 |
| 4,606,737 | 8/1986 | Stein | 8/115.6 |

*Primary Examiner*—Hubert C. Lorin
*Attorney, Agent, or Firm*—Sughrue, Mion, Zinn, Macpeak & Seas

[57] ABSTRACT

A process for producing preoxidized fibers, which comprises preoxidizing acrylic fibers having a fluorine-containing surface active agent and at least one phosphoric surface active agent selected from the group consisting of compounds represented by the following formulae (I), (II) and (III), and preoxidizing the acrylic fibers thus-obtained:

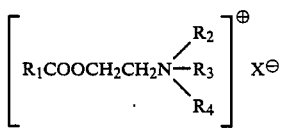

(I)

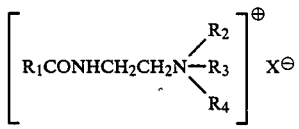

(II)

$[R_1CON(CH_2CH_2OH)_2]X'$ (III)

wherein $R_1$ represents an aliphatic hydrocarbon group having 1 to 17 carbon atoms, $R_2$, $R_3$ and $R_4$, which may be the same or different, and each represents a hydrogen atom, a lower alkyl group, a hydroxyethyl group or a hydroxyisopropyl group,

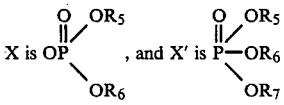

wherein $R_5$, $R_6$ and $R_7$, which may be the same or different, each represents a hydrogen atom or a hydroxyethyl group.

27 Claims, No Drawings

PROCESS FOR PRODUCING PREOXIDIZED FIBERS FROM ACRYLIC FIBERS

This is a continuation-in-part of application Ser. No. 883,399, filed July 8, 1986, now abandoned, which is a division of application Ser. No. 610,080, filed May 14, 1984, now U.S. Pat. No. 4,659,623.

FIELD OF THE INVENTION

The present invention relates to a method for producing preoxidized (flame-resistant) fibers from acrylic fibers at high temperatures. The present invention also relates to processes for producing carbon fibers having high qualities and high strength from such preoxidized fibers.

BACKGROUND OF THE INVENTION

It has heretofore, been known to obtain carbon fibers by subjecting acrylic fibers to preoxidation in an oxidizing atmosphere (containing oxygen) at 200 to 300° C., preferably under tension, and then subjecting the resulting preoxidized fibers to carbonization in an inert gaseous atmosphere at 500° C. or higher, preferably under tension (these methods are describe in, for example, U.S. Pat. No. 4,069,297).

In these manufacturing processes, the preoxidation is an oxidation reaction. At high temperature the preoxidation can be carried out in a short period of time and is economical. However, when the preoxidation is carried out at high temperature heat is locally built up in the fibers and causes coalescence of the preoxidized fibers to one another. Carbon fibers having high qualities and high strength cannot be obtained from such preoxidized fibers.

In order to preventing coalescence, it has been proposed, for example, to adhere a cationic surface-active agent to the starting acrylic fibers (such is described in Japanese Patent Publication (unexamined) 112410/1982). To conduct preoxidation in a short period of time, it is required to effect the treatment at a higher temperature. With the above proposed technique, it is difficult to prevent coalescence of the preoxidized fibers during preoxidation at high temperature.

SUMMARY OF THE INVENTION

One object of the present invention is to provide a method by which preoxidized fibers can be produced without coalescence even when preoxidation is carried out at high temperature.

It is another object of the present invention to provide preoxidized fibers which undergo substantially no fiber coalescence.

It is still another object of the present invention to provide preoxidized fibers suitable for producing high strength carbon fibers with less fluffs and a process for producing such carbon fibers.

In the present invention preoxidized fibers are obtained by preoxidizing acrylic fibers having a fluorine-containing surface active agent and at least one phosphoric surface active agent represented by the following formulae (I), (II) and (III):

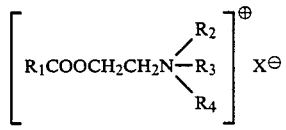

(I)

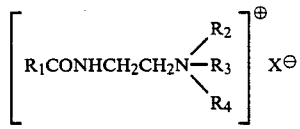

(II)

$$[R_1CON(CH_2CH_2OH)_2]X' \quad \text{(III)}$$

wherein $R_1$ represents an aliphatic hydrocarbon group having 11 to 17 carbon atoms, $R_2$, $R_3$ and $R_4$ may be the same or different and each represents a hydrogen atom, a lower alkyl group, preferably having 1–3 carbon atoms, a hydroxyethyl group or a hydroxyisopropyl group,

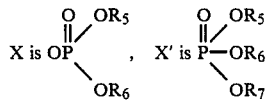

herein $R_5$, $R_6$ and $R_7$ may be the same or different and each represents a hydrogen atom or a hydroxyethyl group.

When the acrylic fibers of this invention having a fluorine-containing surface active agent and at least one of surface active agents of formulae (I), (II) and (III) applied thereto are used, fiber coalescence does not occur in the preoxidation treatment at high temperatures. In addition, suitable bundlability is imparted to the fiber bundle so that the occurrence of fluffs or the wrapping of the fibers around the guide roller can be prevented. This in turn leads to a reduction in the occurrence of fluffs or the wrapping of the fibers around the guide roller during carbonization.

The acrylic fibers used in this invention are obtained from a homopolymer or a copolymer preferably composed of at least 95 mole% of acrylonitrile and not more than 5 mole% of a vinyl monomer copolymerizable with acrylonitrile.

The vinyl monomer or comonomer component may be any known unsaturated vinyl compound copolymerizable with acrylo-nitrile. Examples include methyl acrylate, ethyl acrylate, methyl methacrylate, acrylamide, N-methylol acrylamide, vinykl acetate, acrylic acid, methacrylic acid, itaconic acid, sodium allylsulfonate, sodium methallylsulfonate, and salts thereof.

Generally, the acrylic fibers are produced by polymerizing acrylonitrile or at least 95 mole% of acrylonitrile and not more than 5 mole% of a vinyl monomer copolymerizable with acrylonitrile in a known solvent for polyacrylonitrile (dimethylformamide, a concentrated aqueous solution of zinc chloride, dimethyl sulfoxide, dimethylacetamide) using a known catalyst (benzolyl peroxide, hydrogen peroxide, sodium persulfate, thereafter forcing the solution of the resulting acrylonitrile homopolymer or copolymer having a molecular weight of 40,000 to 200,000 under pressure through orifices into a dilute solvent solution, removing the solvent from the resulting filaments to obtain gel fibers, and then drying, stretching and relaxing the filaments.

The resulting fibers usually consists of a bundle of 500 to 100,000 monofilamants having a size of 0.1 to 3.0 denier. In the production of acrylonitrile fibers, generally, treatments such as stretching, drying and relaxing are carried out after spinning and solvent removal.

The fluorine - containing surface active agent which is used in this invention are commercially available. Examples are shown below.

Nonionic surface active agent (1) Oligomers having a perfluoroalkyl group having preferably 5–8 carbon atoms, a hydrophilic group such as polyoxyethylene group derived from ethylene oxide, and oleophilic groups such as polyoxypropylene group derived from propylene oxide. Examples of this agent include oligomers obtained by polymerization of (i) a compound represented by the following general formula $C_8F_{17}SO_2N\ R_2CH_2CH_2OOCCH{=}CH_2$(wherein $R_2$ represents an alkyl group having 1–3 carbon atoms), (ii) an acrylic monomer of polyoxyethylene containing 10–50 of oxyethylene units, and (iii) an acrylic monomer of polyoxypropylene containing 10–50 of oxypropylene units. A specific example of such oligomer includes F-177 which is an oligomer having a molecular weight of 2,500 to 10,000 and $R_2$ is $C_3H_7$ group.

(2) Oligomers having a perfluoroalkyl group and hydrophilic group, wherein both groups are the same as disclosed in (1), respectively. A specific example of such oligomer includes F-171 which is an oligomer having a molecular weight of 2,500 to 10,000 and $R_2$ is $C_3H_7$ group. (Molecular weight of a polymer in this invention is obtained in accordance with Staudinger's equation.)

(3) Perfluoroalkylsulfamoylethylene oxide adducts having the formula $R_1SO_2NR_2\ (C_2H_4O)_nH$ (wherein $R_1$ is a perfluoroalkyl group having preferably 5 to 8 carbon atoms, $R_2$ is an alkyl group having 1–3 carbon atoms and n is preferably 10 to 20)

Example: F-142D : $R_1{=}C_8F_{17}$, $R_2{=}C_3H_7$, n=10

Example: F-144D : $R_1{=}C_8F_{17}$, $R_2{=}C_3H_7$, n=20

Anionic surface active agent (1) Perfluoroalkylsulfonic acid salts having the formula $R_1SO_3M$ (the definition for $R_1$ is the same as disclosed hereinabove and M is Na or K)

Example: F-110 : $C_8F_{17}SO_3K$

Example: F-113 : $C_5F_{11}$ - $C_8F_{17}SO_3K$ (mixture)

(2) Perfluoroalkylsulfamoylcarboxylic acid salts having the formula $R_1SO_2NR_2CH_2COOM$ (wherein definitions for $R_1$, $R_2$ and M are the same as disclosed hereinabove)

Example: F120 : $R_1{=}C_8F_{17}$, $R_2{=}C_3H_7$, M=K (3) Perfluoroalkylsulfamoylphosphate of the formula $$R_1SO_2NR_2CH_2CH_2O{-}\overset{\overset{\displaystyle O}{\|}}{P}{-}(OH)_2$$

(wherein definitions for $R_1$ and $R_2$ are the same as disclosed hereinabove)

Example: F-191 : $R_1{=}C_8F_{17}$, $R_2{=}C_3H_7$

Cationic surfactants (1) Perfluoroalkylsulfamoyl trimethyl ammonium salts of the formula;

$$[R_1SO_2NHCH_2CH_2CH_2N(CH_3)_3]\oplus X\ominus$$

(wherein the definition for $R_1$ is the same as disclosed hereinabove and X is Ce, I or $CH_3COO$)

Example: F-150 : $R_1{=}C_8F_{17}$, X=I

The above designations, such as F-177, are designations of Dai-Nippon Ink and Chemicals, Inc., the manufacturer.

Furthermore, in the present invention the fluorine-containing surface-active agent can be applied to the fibers as a mixture with a surface-active agent represented by formula (I), (II) or (III) earlier given.

In formulae (I), (II) and (III) $R_1$ represents an aliphatic hydrocarbon group having 11 to 17 carbon atoms, particularly a straight-chain saturated aliphatic hydrocarbon group; $R_2$ to $R_4$ each represent a hydrogen atom, a lower alkyl group preferably having 1 to 3 carbon atoms, such as a methyl or ethyl group, a hydroxyethyl group, or a hydroxyisopropyl group; and X represents a phosphoric acid ion or a phosphoryl mono-(di-, or tri-) hydroxyethyl ion as earlier defined.

The compounds represented by formulae (I), (II) and (III) may be used singly or as a mixture of two or more thereof.

Examples of the compounds of formula (I) are shown below.

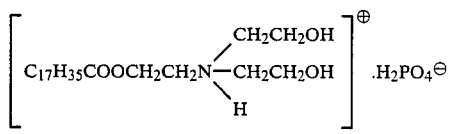

(I)-(1)

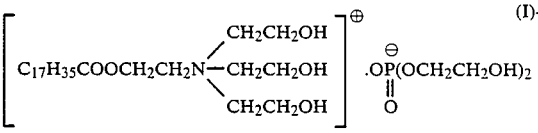

(I)-(2)

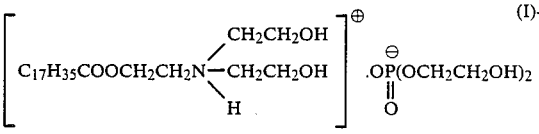

(I)-(3)

An example of the compounds of formula (II) is as follows:

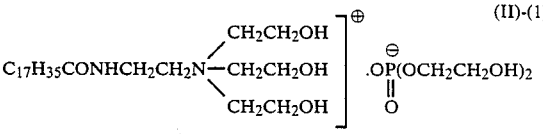

(II)-(1)

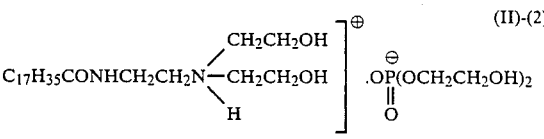

(II)-(2)

An example of the compounds of formula (III) is as follows:

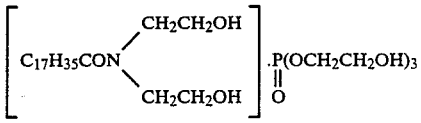

(III)-1

The surface active agent (or agents) used in the present invention is applied to the acrylic fiber during or after production thereof when the acrylic fibers are produced by wet spinning. The surface active agent is preferably applied to the acrylic fiber after removal of the solvent used for spinning. It is more preferable to apply before drying the gel fibers obtained after removal of the solvent because stretchability and proccesability of fibers can be further improved. Stretching may be conducted during the production of the acrylic fiber of the present invention in a conventional manner.

To apply the surface active agent to the fibers, an aqueous solution or dispersion of the surface active agent can be used.

The phosphoric surface active agent may be applied to the fibers after, or before applying the fluorine-containing surface active agent(s), preferably before, or the phosphoric surface active agent may be incorporated in the solution or dispersion of the fluorine-containing surface active agent. When treatments with the surface active agents are conducted separately from each other, it is preferable to conduct drying, usually at about up to 150° C. after the first treatment. As a solvent or medium of forming a solution or a dispersion, water or an organic solvent such as methanol, ethanol, isopropyl alcohl, aceton or mixture thereof may be used.

The applying is generally conducted by immersing an acrylic fiber bundle into the solution or dispersion or by spraying the solution or dispersion onto the bundle. It is not necessary to use a solution or dispersion containing the surface active agent or agents at high temperature. The temperature is usually 10 to 60° C., and preferably not higher than 50° C.

The concentration of the fluorine-containing surface active agent, the phosphoric surface active agent, or the mixture thereof is preferably 1.0 to 15 g/liter and more preferably 3 to 6 g/liter. The amount of a surface active agent to be applied can be adjusted by varying the concentration of the surface active agent.

When acrylic fivers are produced by melt spinning the surface active agent (or agents) may be applied to the fibers at any time by, for example, incorporating it to an acrylic polymer to be subjected to melt spinning. Alternatively, the surface active agent (or agents) may be applied to the fiber after production of the acrylic fibers. Furthermore one of the fluorine-containing surface active agent and the phosphoric surface active agent may be incorporated to the acrylic polymer before spinning and the other agent may be applied after spinning of the acrylic fibers.

When a solution or dispersion of the surface active agent (or agents) is used for application of the surface active agent, generally, drying is conducted after the application. The drying is preferably conducted at a temperative of up to 150° C.

The surface active agents thus supplied to acrylic fibers adhered on the surface of the fiber, impregnates to the fiber and/or is present uniformly through the fiber depending on the method for applying the surface active agent to the acrylic fiber.

When the phosphoric surface active agent is used singly for a long period of time, an oil scum is undesirably formed in the solution or dispersion thereof. However, when the phosphoric surface active agent is used with the fluorine-containing surface active agent this increases the dispersability of the system and is effective to prevent the formation of the oil scum.

The proportion of the phosphoric surface active agent applied to the fibers is up to 95% by weight of the total amount of the surface active agents applied to the fibers. The preferred proportion is 30 to 90% by weight. Addition or more than 95% by weight of the phosphoric surface active agent is not effective to prevent coalescence of preoxidized fibers and does not yield carbon fibers having high strength.

When the phosphoric surface active agent is not used, the bundlability (gathering property for maintaining fibers in one bundle) of the acrylic fibers is somewhat reduced but the resulting carbon fibers have high strength. The amount of the fluorine-containing surface active agent or the total amount of the fluorine-containing surface active agent and the phosphoric surface active agent applied to the acrylic fibers is 0.01 to 0.5% by weight based on the treated acrylic fibers (i.e., based on the total weight of the surface active agents and the crylic fibers). If it is less than 0.01%, it is difficult to sufficiently obtain the effect of the present invention. Application of a great amount of the surface active agents beyond 0.5% tends to reduce the effect. The preferred amount is 0.03 to 0.1%.

The preoxidation of the acrylic fibers of this invention having the surface active agents applied thereto can be carried out by using any conventional preoxidation conditions for acrylic fibers.

Even when the preoxidation was conducted at a high temperature, no coalescence was observed with preoxidized fibers per the present invention.

Since no coalescence occurs even when the preoxidation is carried out at high temperature, the preoxidation can be carried out effectively within a short period of time. Preferably, the preoxidation treatment is carried out in air at 250 to 350° C., especially 260 to 290° C., for 0.1 to 1 hour under a tension of 10 to 100 mg/d until the specific gravity of the fibers becomes 1.40 to 1.45.

Carbonization of the thus obtained preoxidized fibers is carried out using conventional carbonization conditions, that is, it is generally carried out in an inert gas atmosphere such as nitrogen, argon or helium at 1000 to 1500° C. under a tension of 10 to 100 mg/d. As a result, carbon fibers having a tenacity of more than 450 $kg/mm^2$ can be obtained in a stable manner.

Examples of this invention are shown below together with Comparative Examples.

Method of measuring coalescence

Preoxidized fiber strands or carbon fiber strands were cut to a length of 3 mm, put in acetone and subjected to ultrasonic washing. The surface active agent was removed by dissolution and the number of thick coalesced filaments was counted under a microscope at a magnification of 6.3.

Method for counting number of fluffs

A 12,000 filament strand is dipped in acetone to remove the surface active agent. The strand is stretched over a span of about 1.3 meters, and acetone is removed by air drying. Then air is blown to open the strand. The number of fluffs on a length of 1 meter is counted.

Stretching is controlled by varying the speed of rollers which transfer fibers, and the degree of stretching is shown by the ratio of the linear speed of the roller to the speed of fibers at spinning.

Unless otherwise indicated herein, all parts, percents, ratios and the like are by weight.

COMPARATIVE EXAMPLE 1

100 parts of a mixture of 98 mole% of acrylonitrile, 0.5 mole% of acrylic acid, 1.5 mole% of methyl acrylate and 1 part of sodium persulfate was dissolved in 1000 parts of a 60% aqueous solution of zinc chloride, and polymerized at 55° C. for 4 hours to obtain a solution of an acrylic polymer having a molecular weight of 55,000 and viscosity of 98 poises (obtained in accordance with Staudinger's equation). The polymer solution was forced into a 25% aqueous solution of zinc chloride through a nozzle with 12,000 orifices and a diameter of 0.05 mm, and then, while washing the filaments with water to remove zinc chloride from them, the filaments were drawn to 3 times. Separately, an aqueous solution of an oligomer of F-177 in a concentration of 5 g/liter was prepared. The fibers drawn to 3 times were dipped in this aqueous solution for 0.2 minute, dried at 120° C., and then continuously drawn to 4.5 times in saturated steam at 125° C. to give acrylic fibers having amonofilament denier of 0.9, a tenacity of 8 g/d and an elongation of 7.5%. Ten grams of the resulting fibers were extracted with a mixture of equal amounts of ethanol and benzene by means of a Soxhlet extractor, and the amount of the surface active agent adhered and inpregnated to the fibers was measured. It was 0.06%. The actrylic fibers (12,000 filaments) so obtained were subjected to preoxidation in air at 270° C. under a tension of 30 mg/d for 40 minutes. The resulting preoxidized fibers had a specific gravity of 1.40, and no coalescence among the monfilaments was observed under a microscope at a magnification of 6.3. The preoxidized fibers were carbonized in a stream of nitrogen at 1400° C. under a tension of 30 mg/d for 1 minute to give carbon fibers of high tenacity having a tensile strength of 490 kg/mm$^2$ and a tensile modulus of 24,500 kg/mm$^2$.

No coalescence among the monofilaments was observed in the resulting carbon fibers, however, number of fluffs was 93/m.

COMPARATIVE EXAMPLE 2

Fibers drawn to 3 times, which had been obtained under the same operating conditions as in Comparative Example 1, were treated with an aqueous solution or an isopropyl alcohol/water mixed solution (a 23% aqueous solution of isopropyl alcohol) of each of the fluorine-containing surface active agent shown in Table 2 at a concentration of 5 g/liter under the same operating conditions as in Comparative Example 1.

The acrylic fibers shown in the Table 1 were obtained.

TABLE 1

| Type of the fluorine-containing surface active agent | Solvent | Properties of Acrylic Fibers |
|---|---|---|
| Anionic F-191 | 23% isopropyl alcohol aqueous solution | Monofilament denier 0.9 Tenacity 7.8 g/d Elongation 8.1% |
| Cationic F-150 | Water | Monofilament denier 0.9 Tenacity 7.3 g/d Elongation 8.2% |

The amount of each of the surface active agents applied to the acrylic fibers was measured in the same way as in Comparative Example 1 using 10 g of fiber sample. It was found that the amount of the anionic surface active agent was 0.05%, and the amount of the cationic surface active agent was 0.06%. The resulting acrylic fibers (12,000 filaments) were subjected to preoxidation in air at 270° C. under a tension of 30 mg/d for 40 minutes. The resulting fibers has a specific gravity of 1.40 and no coalescene among the monofilaments was observed under a microscope at a magnification of 6.3.

The flame-resistant fibers were carbonized in a stream of nitrogen at 1400° C. under a tension of 30 mg/d for 1 minute. Carbon fibers having the properties shown in Table 2 were obtained.

TABLE 2

| Type of the fluorine-containing surface active agent | Properties of the carbon fibers | |
|---|---|---|
| Anionic F-191 | Tensile strength | 480 kg/mm$^2$ |
| | Tensile modulus | 24,400 kg/mm$^2$ |
| | Number of fluffs | 90/m |
| Cationic F-150 | Tensile strength | 485 kg/mm$^2$ |
| | Tensile modulus | 24,400 kg/mm$^2$ |
| | Number of fluffs | 92/m |

No coalescence among the monofilaments was observed with either of these carbon fibers, however number of fluffs was 90/m and 92/m, respectively.

EXAMPLE 1

Fibers drawn to 3 times, which were obtained at the same operating conditions as in Comparative Example 1, were treated with a 5 g/liter aqueous solution of 70% of a phoshporic surface active agent of formula (III)-(1) and 30% of a fluorine-containing surface active agent, F-177 under the same operating conditions as in Comparative Example 1 to obtain acrylic fibers having a monofilament denier of 0.9, a tenacity of 7.8 g/d and an elongation of 8%. The amount of the mixed surface active agents applied to the acrylic fibers, measured by using a 10 g fiber sample in the same way as in Comparative Example 1, was 0.07%.

The acrylic fibers so obtained (12,000 filaments) were subjected to preoxidation in air at 270° C. under a tension of 30 mg/d for 40 minutes. The resulting preoxidized fibers had a specific gravity of 1.40, and no coalescence among the monofilaments was observed under a microscope at a magnification of 6.3. The preoxidized fibers were carbonized in a stream of nitrogen at 1400° C. under a tension of 30 mg/d for 1 minute to obtain carbon fibers of high strength having a tensile strength of 460 kg/mm$^2$ and a tensile modulus of 24,300 kg/mm$^2$. No coalescence among the monofilaments was observed in the resulting carbon fibers. Number of fluffs was 60/m.

EXAMPLE 2

Fibers drawn to 3 times, which were obtained at the same operating conditions as in Comparative Example 1, were treated with a 5 g/liter aqueous solution of a mixture of 50% of F-142D and 50% of the phosphoric surface active agent of formula (II)-(2) under the same operating conditions as in Comparative Example 1 to obtain acrylic fibers having a monofilament denier of 0.9, a tenacity of 7.6 g and an elongation of 7.5%. The amount of the mixed surface active agents adhered to the acrylic fibers, measured by using a 10 g fiber sample in the same way as in Comparative Example 1, was 0.06%.

The resulting acrylic fibers (12,000 filaments) were subjected to preoxidation in air at 270° C. under a tension of 30 mg/d for 40 minutes. The resulting fibers had a specific gravity of 1.40 and no coalescence among the monofilaments was observed under a microscope at a magnification of 6.3. The preoxidized fibers were carbonized in a stream of nitrogen at 1400° C. under a tension of 30 mg/d for 1 minute to obtain high-strength carbon fibers having a tensile strength of 470 kg/mm$^2$ and a tensile modulus of 24,300 kg/mm$^2$. No coalescence among the monofilaments was observed in these carbon fibers. Number of fluffs was 65/m.

EXAMPLE 3

Using the Example 2 fibers drawn to 3 times they were treated with a 5 g/liter aqueous solution of a mixture of 97% of the phosphoric surface active agent of formula (II)-2 and 3% of the fluorine-containing surface active agent, F-142D under the same operating conditions as in Comparative Example 1 to obtain acrylic fibers having a monofilament denier of 0.9, tenacity of 7.5 g/d and an elongation of 7.5%. The amount of the mixed surface active agent applied to the acrylic fibers, measured using a 10 g fiber sample in the same way as in Comparative Example 1, was 0.05%.

The resulting acrylic fibers (12,000 filaments) were subjected to preoxidation in air at 270° C. under a tension of 30 mg/d for 40 minutes. The resulting preoxidized fibers had a specific gravity of 1.40, and coalescence among the monofilaments was scarcely observed under a microscope at a magnification of 6.3. The preoxidized fibers were carbonized in a stream of nitrogen at 1400° C. under a tension of 30 mg/d for 1 minute to obtain carbon fibers having a tensile strength of 430 kg/mm$^2$ and a tensile modulus of 24,200 kg/mm$^2$. Coalescence among the monofilaments was scarcely observed in these carbon fibers. Number of fluffs was 55/m.

EXAMPLE 4

Fibers drawn to 3 times, obtained under the same conditions as in Comparative Example 1, were treated with a 5 g/liter aqueous solution of a mixture of 60% phosphoric surface active agent of formula (I)-(3) and 40% of the fluorine-containing surface active agent, F-177 under the same operating conditions as in Comparative Example 1 to obtain acrylic fibers having a monofilament denier of 0.9, a tenacity of 7.6 g/d and an elongation of 7.5%. The amount of the mixed surface active agents applied to the acrylic fibers, measured using a 10 g fiber sample in the same way as in Comparative Example 1, was 0.06%.

The resulting acrylic fibers (12,000 filaments) were subjected to preoxidation in air at 270° C. under a tention of 30 mg/d for 40 minutes. The resulting fibers had a specific gravity of 1.40, and no coalescence among the monofilaments was observed under a microscope at magnification of 6.3.

The preoxidized fibers were carbonized in a stream of nitrogen at 1400° C. under a tension of 30 mg/d to obtain carbon fibers having a tensile strength of 470 kg/mm$^2$ and a tensile modulus of 24,400 kg/mm$^2$. No coalescence among the monofilaments was observed in the carbon fibers. Number of fluffs was 673/m.

EXAMPLE 5

Fibers drawn to 3 times, obtained under the same operating conditions as in Comparative Example 1, were treated with a 5 g/litter aqueous solution of a mixture of 95% of the phosphorice surface active agent of formula (III)-(1) and 5% of the fluorine-containing surface active agent F-191:

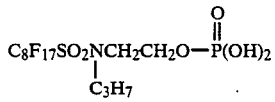

in the same way as in Comparative Example 1 to obtain acrylic fibers having a monofilament denier of 0.9, a tenacity of 7.5 g and an elongation of 7.7%. The amount of the mixed surface active agents applied to the acrylic fibers, measured using a 10 g fiber sample in the same way as in Comparative Example 1, was 0.06%.

The resulting acrylic fibers (12,000 filaments) were subjected to preoxidizing in air at 270° C. under a tension of 30 mg/d for 40 minutes. The resulting preoxidized fibers had a specific gravity of 1.40 and no coalescence among the monofilaments was observed under a microscope at a magnification of 6.3. The preoxidized fibers were carbonized in a stream of nitrogen at 1400° C. under a tension of 30 mg/d for 1 minute to obtain carbon fibers having a tensile strength of 480 kg/mm$^2$ and a tensile modulus of 24,400 kg/mm$^2$. No coalescence among the monofilaments was observed in these carbon fibers. Number of fluffs was 55/m.

COMPARATIVE EXAMPLE 3

Fibers drawn to 3 times, obtained under the same operating conditions as in Comparative Example 1, were treated with a 5 g/liter aqueous solution of 100% of phosphoric surface active agent (III)-(1) under the same operating conditions as in Comparative Example 1 to obtain acrylic fibers having a monofilament denier of 0.9, tenacity of 6.8 g/d and an elongation of 7.0%. The amount of the surface active agent applied to the acrylic fibers, measured using a 10 g fiber sample in the same way as in Comparative Example 1, was 0.07%. The resulting acrylic fibers (12,000 filaments) were subjected to preoxidizing in air at 270° C. under a tension of 30 mg/d for 40 minutes. The resulting preoxidized fibers had a specific gravity of 1.40, and when they were observed under a microscope at a magnification of 6.3, coalescence among the monofilaments was noted. The preoxidized fibers were carbonized in a stream of nitrogen at 1400° C. under a tension of 30 mg/d for 1 minute to obtain carbon fibers having a tensile strength of 420 kg/mm$^2$ and a tensile modulus of 24,400 kg/mm$^2$. Thirty to forty coalesced portion in the carbon fibers, were observed. Number of fluffs was 54/m.

EXAMPLE 6

Fibers drawn to 3 times, obtained under the same operating conditions as in Comparative Example 1, were immersed for 0.2 minute in a 4.6 g/liter aqueous solution of phosphoric surface active agent (I) (3) and dried at 120° C. to obtain a fiber bundle having 0.055% of the compound applied thereto. Then, the fiber bundle was immersed in a 0.4 g/liter aqueous solution of the fluorine-containing surface active agent represented by the following formula

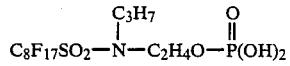

and dried to adhere 0.005% of this compound to the fiber bundle. It was then treated under the same operating conditions as in Comparative Example 1 to obtain acrylic fibers having a monofilament denier of 0.9, a tenacity of 7.6 g/d and an elongation of 7.5%.

These fibers were subjected to preoxidation and carbonization in the same way as in Comparative Example 1 to yield carbon fibers having a tensile strength of 470 kg/mm$^2$ and a tensile modulus of 24,300 kg/mm$^2$ which were free from coalescence among the monofilaments. Number of fluffs was 60/m.

EXAMPLE 7

Fibers drawn to 3 times, obtained under the same operating conditions as in Comparative Example 1, were treated in the same way as in Comparative Example 1 with a 5 g/liter aqueous solution of a mixture of 90% of the phosphoric surface active agent of formula (I)-(3) and 10% of the fluorine-containing surface active agent represented by the following formula

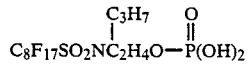

to give acrylic fibers having a monofilament denier of 0.9, a tenacity of 7.6 g/d and an elongation of 7.8%. The amount of the mixture of the above compounds adhered thereto was 0.05%.

These fibers were subjected to preoxidation and carbonization in the same way as in Comparative Example 1 to yield carbon fibers having a tensile strength of 475 kg/mm$^2$ and a tensile modulus of 24,300 kg/mm$^2$ which were free from coalescence. Number of fluffs was 57/m.

Coalescence and fluffs of carbon fibers obtained in Examples 1–7 and Comparative Examples 1–3 in the application are summarized and shown in Table 3 below.

Preoxidation conditions and carbonizing conditions of these Examples and Comparative Examples were the same to each other.

TABLE 3

| | Fluorine Containing Surface Active Agent | Phosphorus Containing surface Active Agent | Coalescence | Number of Fluffing | Note |
|---|---|---|---|---|---|
| Comparative Example 1 | F-177 (100%) | — | no | 93 | Comparative |
| Comparative Example 2 | F-191 (100%) | — | no | 90 | Comparative |
| Example 1 | F-177 (30%) | (III)-(I) (70%) | no | 60 | Invention |
| Example 2 | F-142D (50%) | (II)-(2) (50%) | no | 65 | Invention |
| Example 3 | F-142D (3%) | (II)-(2) (97%) | scarcely | 55 | Invention |
| Example 4 | F-177 (40%) | (I)-(3) (60%) | no | 63 | Invention |
| Example 5 | F-191 (5%) | (III)-(1) (95%) | no | 55 | Invention |
| Comparative Example 3 | — | (III)-(1) (100%) | 30–40 | 54 | Comparative |
| Example 6 | Compound A (8.3%) | (I)-(3) (91.7%) | no | 60 | Invention |
| Example 7 | F-191 (10%) | (I)-(3) (90%) | no | 57 | Invention |

EXAMPLE 8

Fibers drawn to 3 times, which had been obtained under the same operating conditions as in Comparative Example 1, were treated with phosphorous compound (II)-(1) and fluorine-containing surface active agent F-177 in the same manner as in the Example 1 to adhere the compounds in an amount of 0.06%.

Coalescence of the preoxidized fiber and fluffing of carbon fiber were measured in the same manner as in Comparative Example 1 and the thus-obtained results are shown in Table 4 and 5 below.

TABLE 4

| | (Number of Coalescence) | | |
|---|---|---|---|
| | Sample | | |
| | Sample A (Comparison) | Sample B (Invention) | Sample C (Comparison) |
| Preoxidation Condition | Surface Active Agent | | |
| | F-177 | (II)-(1) + F-177 (50%) (50%) | (II)-(1) |
| 1. 260° C., 1.5 hr | no | no | no |
| 2. 255° C., 40 min 280° C., 20 min | " | " | " |
| 3. 270° C., 40 min | " | " | 30–40 |
| 4. 265° C., 20 min 280° C., 10 min | " | " | 30–40 |

TABLE 5

| | (Number of Fluff) | | |
|---|---|---|---|
| | Sample | | |
| | Sample A (Comparison) | Sample B (Invention) | Sample C (Comparison) |
| Preoxidation Condition | Surface Active Agent | | |
| | F-177 | (II)-(1) + F-177 (50%) (50%) | (II)-(1) |
| 1. 260° C., 1.5 hr | 91 | 61 | 61 |
| 2. 255° C., 40 min 280° C., 20 min | 92 | 62 | 57 |

TABLE 5-continued

| Pre-oxidation Condition | (Number of Fluff) Sample: Sample A (Comparison) Surface Active Agent: F-177 | Sample B (Invention) Surface Active Agent: (II)-(1) + F-177 (50%) (50%) | Sample C (Comparison) Surface Active Agent: (II)-(1) |
|---|---|---|---|
| 3. 270° C., 40 min | 93 | 60 | 54 |
| 4. 265° C., 20 min 280° C., 10 min | 94 | 61 | 58 |

(1) Results shown in Table 3 to 5 can be analyzed as follows.

(i) When only a fluorine containing surface active agent (hereinafter referred to as F-agent) is used as a treating agent no coalescence is observed (see Tables 3 and 4). However, in such a case it is inferior in fluffing (see Tables 3 and 5).

(ii) When only phosphoric surface active agent (hereinafter P-agent) is used as a treating agent preoxidized fiber having a lot of coalesced portions is obtained when preoxidation is carried out at a high temperature (see Tables 3 and 4).

(iii) When both of F-agent and P-agent are used as a treating agent carbon fiber superior in fluffing to that obtained from acrylic fiber treated with F-agent only (see Tables 3 and 5) and superior in coalescence to that obtained from acrylic fiber treated with P-agent only can be obtained (see Tables 3 and 4).

While the invention has been described in detail and with reference to specific embodiments thereof, it will be apparent to one skilled the art that various changes and modifications can be made therein without departing from the spirit and scope thereof.

What is claimed is:

1. A process for producing preoxidized fibers with substantially no fiber coalescence, which comprises preoxidizing acrylic fibers having a fluorine-containing surface active agent and at least one phosphoric surface active agent selected from the group consisting of compounds represented by the following formulae (I), (II) and (III), and preoxidizing the acrylic fibers thus-obtained:

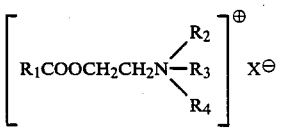

(I)

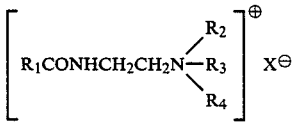

(II)

$[R_1CON(CH_2CH_2OH)_2]X'$ (III)

wherein $R_1$ represents an aliphatic hydrocarbon group having 1 to 17 carbon atoms, $R_2$, $R_3$ and $R_4$, which may be the same or different, and each represents a hydrogen atom, a lower alkyl group, a hydroxyethyl group or a hydroxyisopropyl group,

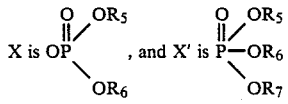

wherein $R_5$, $R_6$ and $R_7$, which may the same or different, each represents a hydrogen atom or a hydroxyethyl group, wherein the total amount of the fluorine-containing surface active agent and the phosphoric surface active agent is up to 0.5% by weight based on the total weight of the acrylic fibers and the surface active agents, and wherein the amount of the phosphoric surface active agent is from 30 to 95% by weight based on the total amount of surface active agent.

2. A process for producing preoxidized fibers as in claim 1, wherein the acrylic fibers are produced by a wet spinning method and the fluorine containing surface active agent is applied to the fibers after removal of solvent used for spinning.

3. A process for producing preoxidized fibers as in claim 2, wherein the fluorine-containing surface active agent is applied to the acrylic fibers before drying of the gel fibers obtained by removal of the solvent.

4. A process for producing preoxidized fibers as in claim 1, wherein said phosphoric surface active agent is applied to the acrylic fibers before or after applying the fluorine-containing surface active agent to the fibers.

5. A process for producing preoxidized fibers as in claim 1, wherein the acrylic fibers are produced by a wet spinning method and the phosphoric surface active agent is applied to the acrylic fibers after removal of solvent used in the spinning of the acrylic fibers.

6. A process for producing preoxidized fibers as in claim 5, wherein the phosphoric surface active agent is applied to the acrylic fibers before drying of the gel fibers obtained by removal of the solvent.

7. A process for producing preoxidized fibers as in claim 1, wherein a mixture of the fluorine-containing surface active agent and the phosphoric surface active agent is applied to the acrylic fibers.

8. A process for producing preoxidized fibers as in claim 1, wherein the acrylic fibers are produced by a wet spinning method and a mixture of the fluorine containing surface active agent and the phosphoric surface active agent is applied to the acrylic fibers after removal of solvent used in the spinning of the acrylic fibers.

9. A process for producing preoxidized fibers as in claim 8, wherein said mixture is applied to the acrylic fibers before drying of the gel fibers obtained by removal of the solvent.

10. A process for producing preoxidized fibers as in claim 1, wherein at least one of the fluorine-containing surface active agent and the phosphoric surface agent is applied to the acrylic fibers using a solution or dispersion thereof.

11. A process for producing preoxidized fibers as in claim 10, wherein the solution or dispersion is applied to the acrylic fibers at a temperature of 10 to 60° C.

12. A process for producing preoxidized fibers as in claim 10, wherein the solution or dispersion contains 1.0 to 15 g/1 of said at least one of surface active agents.

13. A process for producing preoxidized fibers as in claim 1, wherein the acrylic fibers are produced by a melt spinning method and at least one of the fluorine-containing surface active agent and the phosphoric surface agent is incorporated to an acrylic polymer to be subjected to melt spinning.

14. A process for producing preoxidized fibers as in claim 1, wherein said lower alkyl group has 1 to 3 carbon atoms.

15. A process for producing preoxidized fibers as in claim 1, wherein said acrylic fibers comprise a polymer obtained from at least 95 mole % acrylonitrile and not more than 5 mole % vinyl monomer copolymerizable with acrylonitrile.

16. A process for producing preoxidized fibers as in claim 1, wherein the total amount of the fluorine-containing surface active agent and the phosphoric surface active agent is 0.01 to 0.5% by weight based on the total weight of the acrylic fibers and the surface active agents.

17. A process for producing preoxidized fibers as in claim 1, wherein preoxidizing is conducted at 250 to 350° C.

18. A process for producing preoxidized fibers as in claim 17, wherein preoxidizing is conducted at 260° C. to 290° C.

19. A process for producing preoxidized fibers as in claim 1, wherein preoxidizing is conducted for 0.1 to 1 hour.

20. A process for producing preoxidized fibers as in claim 1, wherein the acrylic fibers consist of a bundle of 500 to 100,0000 monofilaments.

21. A process for producing preoxidized fibers as in claim 1, wherein the acrylic fibers have a monofilament size of 0.1 to 3.0 denier.

22. A process for producing acrylic fibers as in claim 1, wherein said fluorine-containing surface active agent is an anionic surface active agent.

23. A process for producing preoxidized fibers as in claim 1, wherein said fluorine-containing surface active agent is a cationic surface active agent.

24. A process for producing preoxidized fibers as in claim 1, wherein said fluorine-containing surface active agent is a cationic surface active agent.

25. A process for producing acrylic fibers as in claim 22, wherein said non-ionic surface active agent is at least one compound selected from the group consisting of oligomers having a perfluoroalkyl group, a hydrophilic group and an oleophilic group, oligomers having a perfluoroalkyl group and a hydrophilic group, and a perfluoroalkylsulfamoylethylene oxide adducts having the formula $R_1SO_2NR_2(C_2H_4O)nH$ (wherein $R_1$ is a perfluoroalkyl group, $R_2$ is an alkyl group and n is 10 to 20).

26. A process for producing preoxidized fibers as in claim 23, wherein said anionic surface active agent is at least one compound selected from the group consisting of perfluoroalkylsulfonic acid salts having the formula $R_1SO_3M$ (wherein $R_1$ is a perfluoroalkyl group and M is Na or K), perfluoroalkylsulfamoylcarboxylic acid salts having the formula $R_1SO_2NR_2CH_2COOM$ (wherein $R_1$ is a perfluoroalkyl group, $R_2$ is an alkyl group, and M is Na or K), and perfluoroalkylsulamoylphosphate of the formula $$R_1SO_2NR_2CH_2CH_2O-\overset{\overset{\displaystyle O}{\|}}{P}-(OH)_2$$

(wherein $R_1$ is a perfluoroalkyl group and $R_2$ is an alkyl group).

27. A process for producing preoxidized fibers as in claim 24, wherein said cationic surfactant is a perfluoroalkylsulfamoyl trimethyl ammonium salt of the formula;

$$[R_1SO_2NHCH_2CH_2CH_2N(CH_3)_3]\oplus X\ominus$$

wherein $R_1$ is a perfluoroalkyl group and X is Ce, I or $CH_3COO$.

* * * * *